US005336068A

United States Patent [19]

Sekiya et al.

[11] Patent Number: 5,336,068

[45] Date of Patent: Aug. 9, 1994

[54] SCROLL-TYPE FLUID MACHINE HAVING THE ECCENTRIC SHAFT INSERTED INTO THE MOVING SCROLL

[75] Inventors: Mutsuo Sekiya; Satoshi Asada; Katsuyuki Fukuhara, all of Sanda, Japan

[73] Assignee: Mitsubishi Denki Kabushiki Kaisha, Tokyo, Japan

[21] Appl. No.: 141,477

[22] Filed: Oct. 26, 1993

Related U.S. Application Data

[63] Continuation of Ser. No. 875,820, Apr. 30, 1992, abandoned.

[30] Foreign Application Priority Data

Jun. 12, 1991 [JP] Japan ..... 3-166240

[51] Int. Cl.[5] ..... F01C 1/04; F04C 18/16

[52] U.S. Cl. ..... 418/55.2

[58] Field of Search ..... 418/55.1, 55.2

[56] References Cited

U.S. PATENT DOCUMENTS 4,466,784 8/1984 Hiraga ..... 418/55.1
5,098,265 3/1992 Machida et al. ..... 418/55.2

FOREIGN PATENT DOCUMENTS 1155086 6/1989 Japan ..... 418/55.1
135195 7/1989 Japan .
2277985 11/1990 Japan ..... 418/55.1
2277988 11/1990 Japan .

OTHER PUBLICATIONS

"The Scroll Machine" by John McCullough et al, Mechanical Engineering/Dec. 1979.

*Primary Examiner*—John J. Vrablik

[57] ABSTRACT

A scroll-type fluid machine is provided in which the oscillating motion at the orbiting movement of a moving scroll is considerably decreased. A projecting portion is formed at the center of a moving scroll and moving scroll shaft bearings are fixed in a shaft hole of the projection portion. The moving scroll is positioned such that its center of gravity is positioned at a portion between the moving scroll shaft bearings. The moving scroll is driven at the center of gravity of the moving scroll to prevent the moving scroll from being oscillated at the orbiting movement. As a result, noise is mitigated and the life of the fluid machines is prolonged since wear caused by the oscillating movement is restricted.

4 Claims, 7 Drawing Sheets

SCROLL-TYPE FLUID MACHINE HAVING THE ECCENTRIC SHAFT INSERTED INTO THE MOVING SCROLL

This application is a continuation of application Ser. No. 07/875,820 filed on Apr. 30, 1992, now abandoned.

BACKGROUND OF THE INVENTION

1. Field of the Invention

This invention relates to a scroll-type fluid machine, and more particular to, a scroll-type fluid machine applied to compressors, pumps or blowers for a refrigerating system or an air-conditioning system.

2. Description of the Related Art

FIG. 7 is a side cross-sectional view of a conventional scroll-type fluid machine and FIG. 8 is a primarily plan view showing operation of the machine. In FIG. 7, reference numeral 1 refers to a fixed scroll having a scroll portion 1*a* illustrated in FIG. 8. Denoted by reference numeral 2 is a moving scroll which has a scroll portion 2*a* illustrated in FIG. 8. Further, reference numeral 3 refers to a compression space having a shape of substantial lunette, which is formed by the scroll portions 1*a* and 2*a*. Reference numeral 4 refers to a discharge opening through which fluid is discharged after being compressed in the compression space 3, reference numeral 5 refers to seal elements disposed at end portions of the scroll portions 1*a* and 2*a* for sealing the compression space 3, reference numeral 6 refers to a moving scroll shaft, reference numeral 7 refers to a moving scroll shaft bearing for supporting the shaft 6. The moving scroll shaft bearing 7 is disposed in a cylindrical portion 2*c* jutting from an end plate 2*b* of the moving scroll 2.

Further, reference numeral 8 is a crank shaft which is eccentrically connected to the moving scroll shaft 6, reference numeral 9 refers to a balancing weight for recovering balance caused by centrifugal force of the scroll, reference numeral 10 refers to a crank shaft bearing, reference numeral 11 refers to a motor, reference numeral 12 refers to a driving shaft for driving the crank shaft 8, reference numeral 13 refers to a housing to which the fixed scroll 1, the crank shaft bearing 10, the motor 11 and the like are fixed, and reference numeral 14 refers to an Oldham's ring for engaging the moving scroll 2 and the housing 13 with each other in the direction that the Oldham's ring 14 crosses them at right angles to prevent the moving scroll 2 from rotating on its own axis.

Next, the operation of the machine will be explained.

When the crank shaft 8 is driven, which is connected to the driving shaft 12 of the motor 11 and is eccentrically connected to the moving scroll shaft 6, the moving scroll 2 is orbited without rotating on its own axis due to the Oldham's ring 14. Then, the scroll portions 1*a* and 2*a* of the fixed scroll 1 and the moving scroll 2 respectively engage with each other eccentrically to form at least one compression space 3.

As shown in FIG. 8, when the moving scroll 2 orbits from 0° to 360° in the direction that the arrow shows in the figure, at least one compression space 3 formed at the periphery of the machine moves toward the center thereof, for causing the fluid to be compressed.

Japanese Patent Publication Kokoku Heisei 1-35195 discloses a conventional scroll-type compressor.

In the conventional scroll-type fluid machine with the structure described above, the moving scroll shaft bearing 7 is fixed at the cylindrical portion 2*c* on the end plate 2*b* of the moving scroll 2 or in the end plate 2*b*. Since the center of gravity of the moving scroll 2 itself is positioned on the scroll portion 2*a*, the moving scroll 2 oscillates about the moving scroll shaft bearing 7 in the direction described by the arrow between the two positions shown by the broken lines as shows in FIG. 9. As a result, a problem is that the scrolling portion 1*a* of the fixed scroll 1 and the scroll portion 2*a* of the moving scroll 2 collide with each other to generate noise and wear of the portions in contact. In such a case, a composite vector of the thrust force and the centrifugal force generates an upsetting moment, for causing the scroll portion 2*a* to be oscillated. To prevent the oscillating motion, a thrust bearing may be installed at the periphery of the moving scroll 2. However, in case that the thrust force is relatively small, the countermeasure cannot be applied to prevent the oscillation.

SUMMARY OF THE INVENTION

The present invention has been accomplished to overcome the above drawbacks of the conventional scroll-type fluid machine and to provide a scroll-type fluid machine in which the oscillating motion is eliminated.

A scroll-type fluid machine according to an embodiment of the present invention comprises: a fixed scroll having a scroll portion; a moving scroll having a scroll portion and a projecting portion projecting to the fixed scroll side with a shaft hole at a center thereof, the scroll portion of the moving scroll being slidably engaged with the scroll portion of the fixed scroll without rotating on its own axis to form at least one compression space, a moving scroll shaft eccentrically connected to a driving shaft of a motor, the moving scroll shaft being inserted into the shaft hole of the moving scroll; at least one moving scroll bearing disposed in the shaft hole for supporting the moving scroll shaft; and a discharge opening formed at a center of the fixed scroll for discharging fluid.

Further, a scroll-type fluid machine according to an embodiment of the present invention is provided with a discharge space which is in connection with the discharge opening by reducing the height of the projecting portion of the moving scroll so as to be lower than that of the scroll portion of the moving scroll. The volume of the discharge space is designed so as to be equal to or slightly smaller that ultimate volume of the compression space to decrease re-expansion at the discharge space, so that a high compression efficiency of the machine results.

BRIEF DESCRIPTION OF THE DRAWINGS

The present invention will be more apparent from the ensuing description with reference to the accompanying drawing wherein.

DETAILED DESCRIPTION OF PREFERRED EMBODIMENTS

Figure 1:
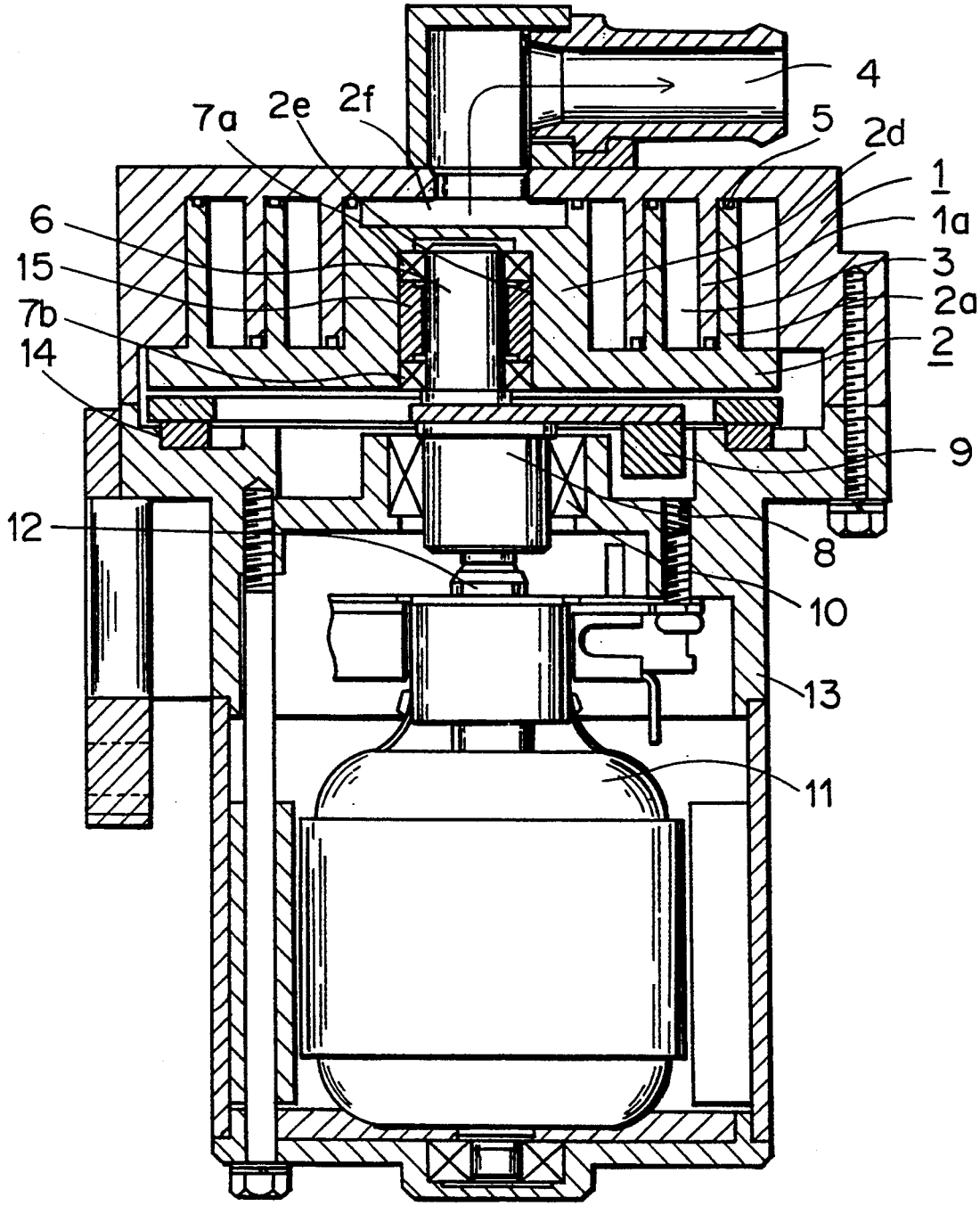
FIG. 1 is a side cross-sectional view of a scroll-type fluid machine according to a first embodiment of the present invention.
Figure 7:
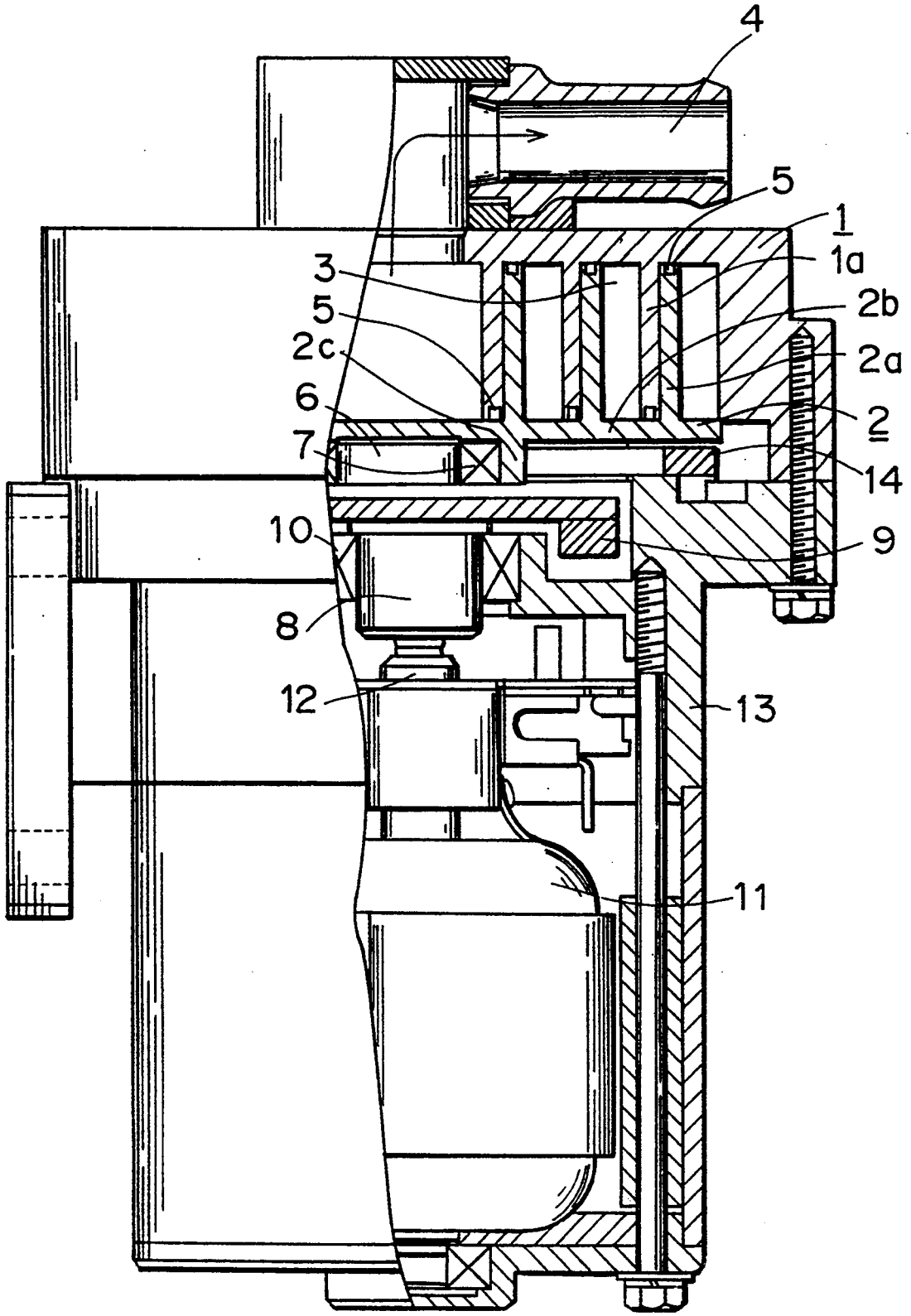
FIG. 7 PRIOR ART
FIG. 7 is a side cross-sectional view of a conventional scroll-type fluid machine.
Figure 8:
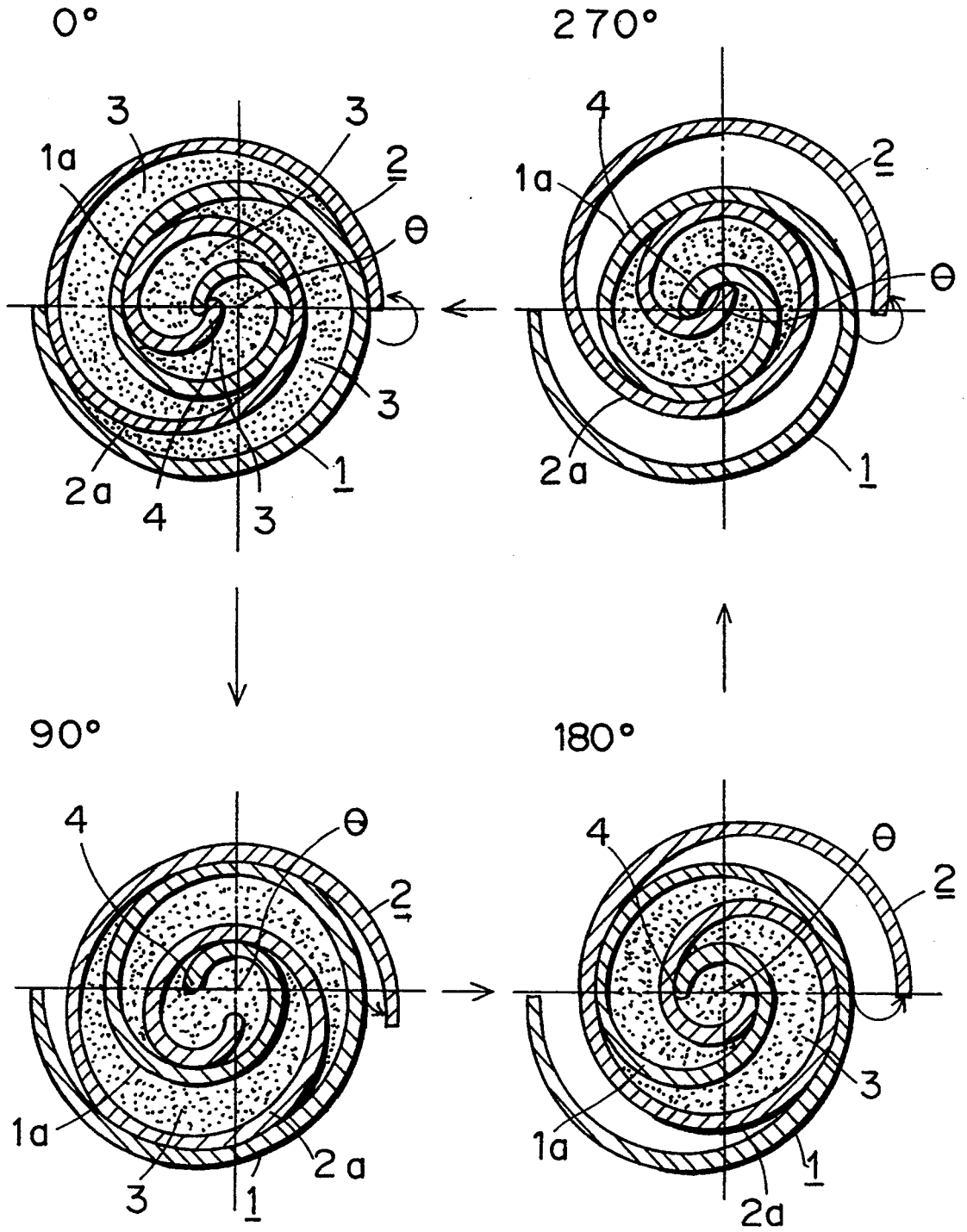
FIG. 8 PRIOR ART
FIG. 8 primarily is a laterally cross-sectional view of the fluid machine of FIG. 7.

The embodiments of the present invention will be explained with reference to drawings. A scroll-type fluid machine according to a first embodiment of the present invention is described in FIGS. 1 to 3. In FIG. 1, like reference characters designate like or corresponding parts in FIG. 7.

Figure 2:
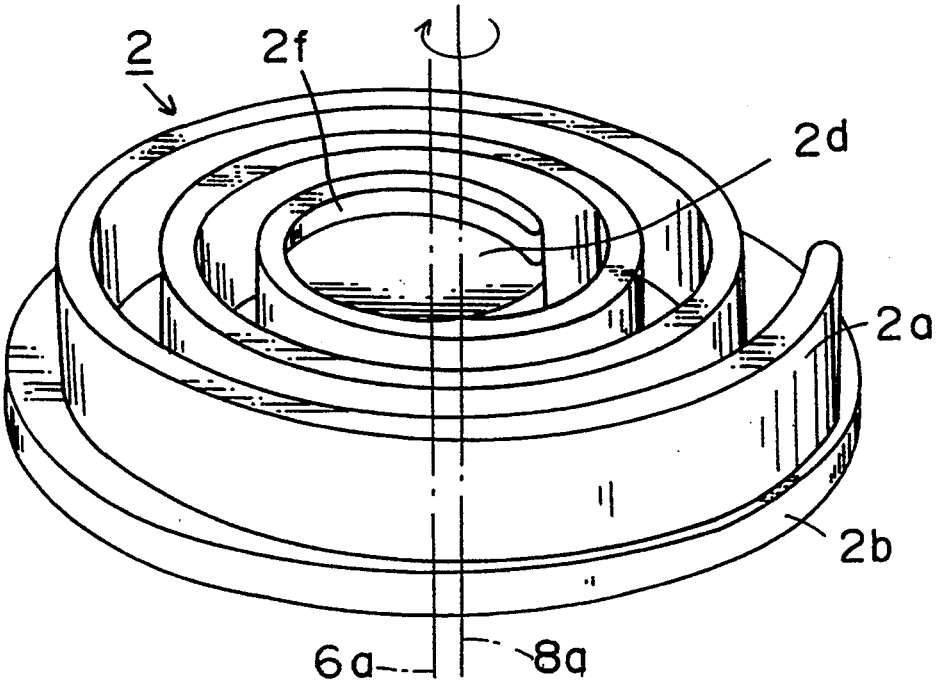
FIG. 2 is a perspective view of a moving scroll of the fluid machine of FIG. 1.
Figure 3:
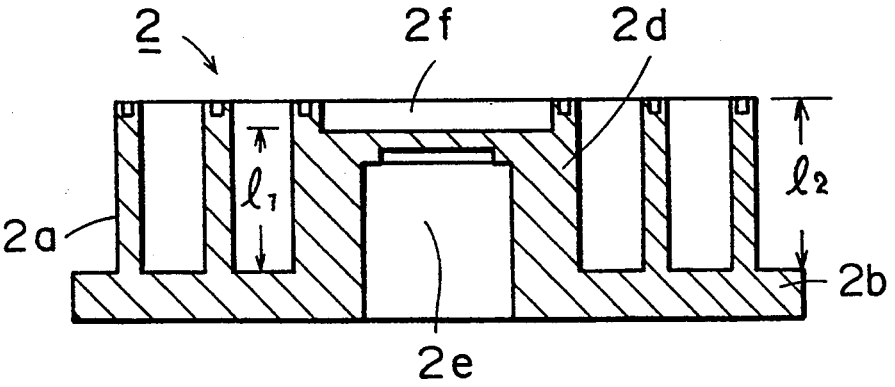
FIG. 3 shows a side cross-sectional view of the moving scroll of FIG. 2.

In FIGS. 1, 2, and 3, reference symbol 2*d* refers to a projection formed at the center of a moving scroll 2, reference symbol 2*e* refers to a shaft hole drilled in the projection 2*d* in such a manner as to include the center of gravity of the moving scroll 2 in the projection 2*d*, through which a moving scroll shaft 6 is inserted. Reference symbols 7*a* and 7*b* refer to moving scroll shaft bearings, which support the upper and lower portions of the moving scroll shaft 6 in the shaft hole 2*e*. Denoted by reference symbol 15 is a spacer inserted between the moving scroll shaft bearings 7*a* and 7*b*. In FIG. 2, reference symbol 6*a* refers to the axis of the moving scroll shaft 6 and reference symbol 8*a* refers to the axis of a crank shaft 8.

As illustrated in FIG. 3, the projection 2*d* is formed so that the height l1 thereof is lower than the height l2 of the scroll portion 2*a*, for permitting a discharge space 2*f* formed at the upper portion of the projection 2*d*, which is in communication with a discharge opening 4.

The operation of the fluid machine will be explained.

A motor is switched on under the condition that the moving scroll shaft 6 is eccentrically sustained by the crank shaft 8 which is connected to a driving shaft 12. The moving scroll 2 is forced to be orbited without rotating on its own axis. A plurality of ball bearings may be used in place of the Oldham's ring to prevent the moving scroll 2 from being rotated on its own axis.

Then, the scroll portion 2*a* of the moving scroll 2 eccentrically engages with the scrolling portion 1*a* of the fixed scroll 1 to form at least one compression space 3. The compression space 3, which is formed at the periphery of the machine, moves toward the center of the scroll portions 1*a* and 2*a* as the moving scroll 2 is orbited to compress the fluid. At the same time, the centrifugal force generated by the orbiting movement is applied to the moving scroll 2 in the direction of the radius thereof. The centrifugal force is applied to the moving scroll shaft bearings 7*a* and 7*b* as a moment.

Figure 9:
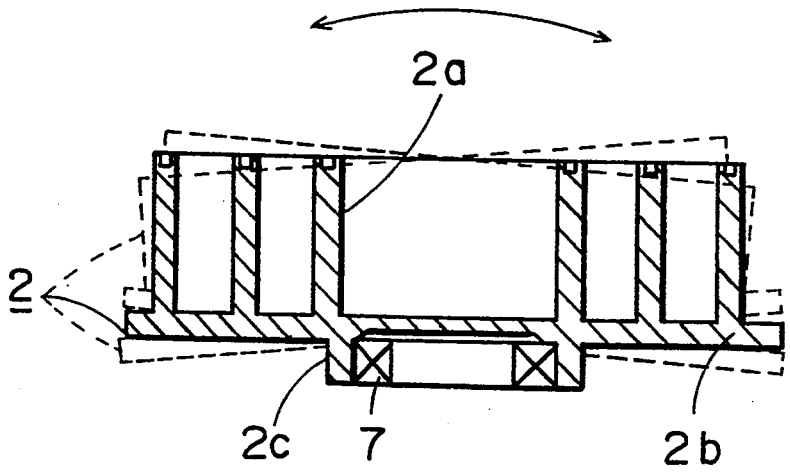
FIG. 9 PRIOR ART
FIG. 9 is a side cross-sectional view for explaining an oscillating motion of the moving scroll of the fluid machine of FIG. 7.

The moving scroll 2 is provided with a projection 2*d* having a shaft hole 2*e* at the center thereof. The height l1 of the projection 2*d* is designed so as to be lower than the height l2 of the scroll portion 2*a* to provide a discharge space 2*f*. The moving scroll shaft bearings 7*a* and 7*b* are fixed in the shaft hole 2*e* of the projection 2*d* and the center of gravity of the moving scroll 2 is positioned in the vicinity of the center of the moving scroll shaft 6 so that the upsetting moment generated by the composite vector of the centrifugal force and the thrust force can be reduced. As a result, the oscillating movement about the moving scroll shaft bearing 7 as shown in FIG. 9 can be mitigated.

The fluid compressed in the compression space 3 is introduced to the discharge opening 4 without being expanded again through the discharge space 2*f* at the upper portion of the projection 2*d*, so that a high efficiency of the fluid machine results.

Further, a reduction in the space of the discharge space 2*f* will increase the compression efficiency of the machine.

Figure 4:
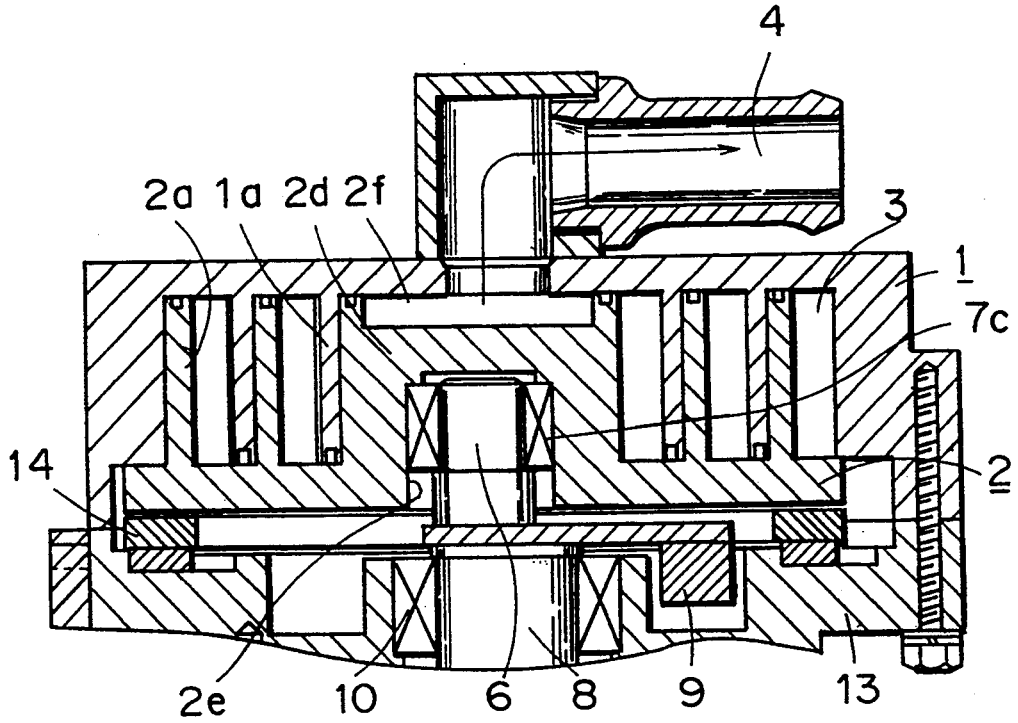
FIG. 4 is a primarily side cross-sectional view of a scroll-type fluid machine according to a second embodiment of the present invention.

A scroll-type fluid machine according to a second embodiment of the present invention is shown in FIG. 4. In the fluid machine, only one moving scroll shaft bearing 7*c* is inserted in the shaft hole 2*e* of the moving scroll 2 in the vicinity of the center of gravity of the moving scroll 2. The moving scroll shaft bearing 7*c* may be a single-row ball bearing or a double-row ball bearing.

Figure 5:
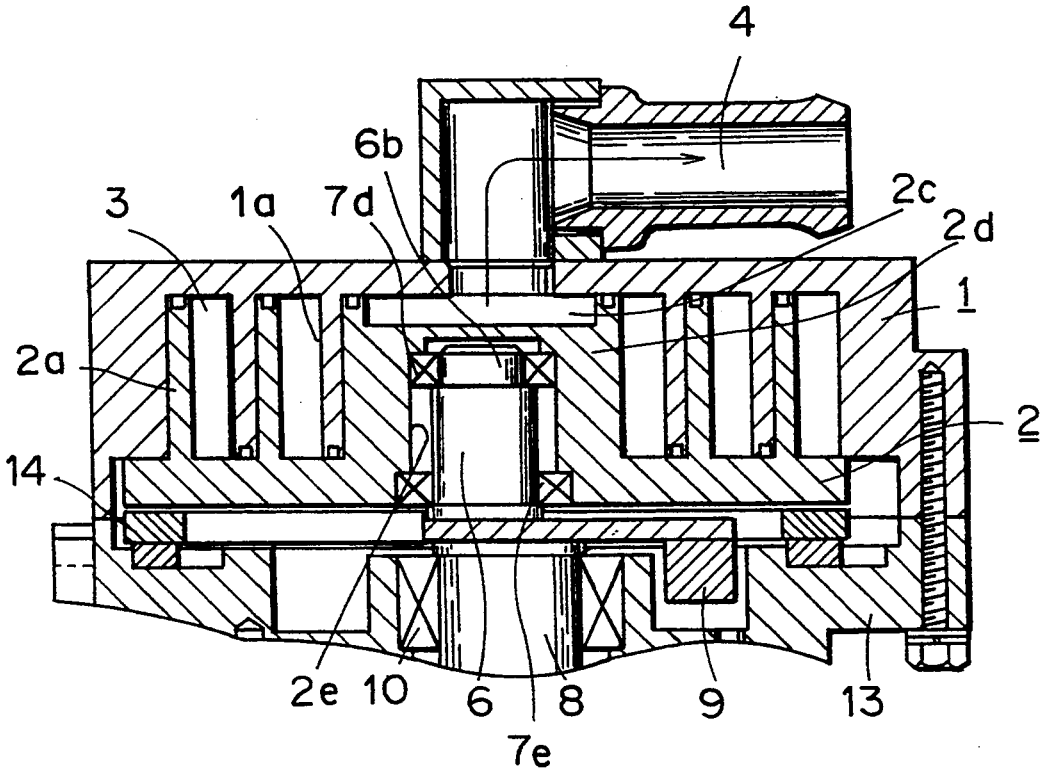
FIG. 5 is a primarily side cross-sectional view of a scroll-type fluid machine according to a third embodiment of the present invention.

FIG. 5 shows a scroll-type fluid machine according to a third embodiment of the present invention. In the fluid machine, moving scroll shaft bearings 7*d* and 7*e* with different size are used. The scroll-type fluid machine of FIGS. 1 and 4 support thrust force with one kind of moving scroll shaft bearing 7*a*, 7*b*, or 7*c*. On the other hand, in FIG. 5, it is the moving scroll bearings 7*d* and 7*e* with different size that support the thrust force, for eliminating the use of the spacer 15 of FIG. 1.

Figure 6:
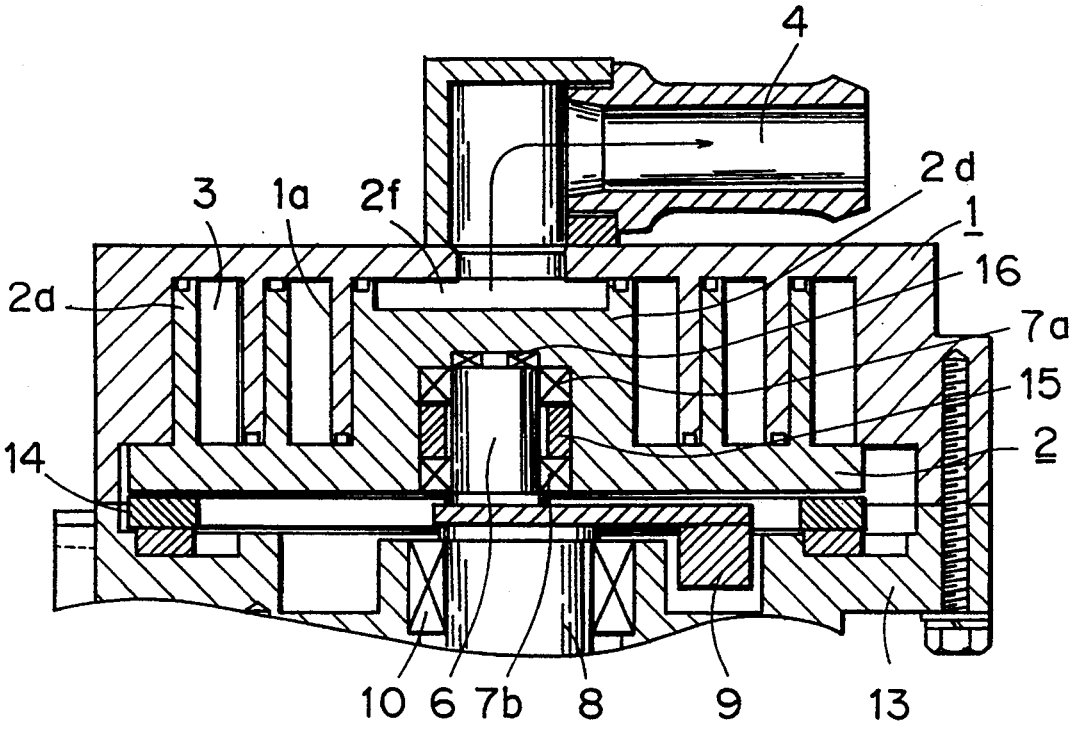
FIG. 6 is a primarily side cross-sectional view of a scroll-type fluid machine according to a fourth embodiment of the present invention.

A scroll-type fluid machine according to fourth embodiment of the present invention is illustrated in FIG. 6. The fluid machine adopts a small thrust bearing 16 at the upper portion of the shaft hole 2*e* of FIG. 1, which is used when the reaction of the compressed fluid is relatively large.

As described above, in the scroll-type fluid machine according to the present invention, a projection is formed at the center of the moving scroll and an oscillating bearing is positioned in the projection to mitigate the oscillating motion of the moving scroll. As a result, noise caused by the impact of the scroll portions are eliminated; the life of the machine is prolonged; and the force required for orbiting the moving scroll 2 can be reduced.

In addition to the above description, the scroll-type fluid machine is provided with a discharge space at the upper portion of the projection, which increases the compression efficiency of the machine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scroll-type fluid machine comprising:

a fixed scroll having a fixed scroll portion;

a moving scroll including a moving scroll portion and a projecting portion projecting to said fixed scroll side with said moving scroll having a shaft hole at a center thereof, said moving scroll portion of said moving scroll being slidably engaged with said fixed scroll portion of said fixed scroll without rotating on an axis of said moving scroll to form at least one compression space;

a moving scroll shaft eccentrically connected to a driving shaft of a motor, said moving scroll shaft being inserted into said shaft hole of said moving scroll;

at least one moving scroll bearing disposed in said shaft hole for supporting said moving scroll shaft; and a discharge opening formed at a center of said fixed scroll for discharging fluid compressed in said compression space through a discharge space being in connection with said discharge opening, said discharge space being formed by a height of said projecting portion of said moving scroll which is lower than a height of said moving scroll portion of said moving scroll for discharging the fluid without being expanded again through said discharge space to achieve a high efficiency for the fluid machine.

2. A scroll-type fluid machine as claimed in claim 1, wherein said moving scroll bearing comprises a single-row ball bearing.

3. A scroll-type fluid machine as claimed in claim 1, wherein said moving scroll bearing comprises first and second moving scroll bearings having different sizes from each other.

4. A scroll-type fluid machine as claimed in claim 1, wherein said moving scroll bearing comprises a double-row ball bearing.

* * * * *